US008505759B2

(12) United States Patent
Sundholm

(10) Patent No.: US 8,505,759 B2
(45) Date of Patent: Aug. 13, 2013

(54) METHOD FOR CLOSING A WASTE BIN FILLING HOLE AND A WASTE BIN

(75) Inventor: Göran Sundholm, Tuusula (FI)

(73) Assignee: Maricap Oy, Vantaa (FI)

( * ) Notice: Subject to any disclaimer, the term of this patent is extended or adjusted under 35 U.S.C. 154(b) by 542 days.

(21) Appl. No.: 12/742,675

(22) PCT Filed: Nov. 10, 2008

(86) PCT No.: PCT/FI2008/050645

§ 371 (c)(1),
(2), (4) Date: May 13, 2010

(87) PCT Pub. No.: WO2009/063130

PCT Pub. Date: May 22, 2009

(65) Prior Publication Data

US 2010/0270302 A1 Oct. 28, 2010

(30) Foreign Application Priority Data

Nov. 14, 2007 (FI) ..... 20075807

(51) Int. Cl.
*B65D 90/22* (2006.01)
*B65D 55/00* (2006.01)

(52) U.S. Cl.
USPC ..... 220/201; 220/88.1; 220/908

(58) Field of Classification Search
USPC ..... 220/88.1, 201, 908
See application file for complete search history.

(56) References Cited

U.S. PATENT DOCUMENTS

| | | | | |
|---|---|---|---|---|
| 2,439,132 | A | | 4/1948 | Hatala et al. |
| 3,796,267 | A | | 3/1974 | Hunter et al. |
| 4,615,454 | A | * | 10/1986 | Verhoog, Jr. ..... 220/88.1 |
| 4,643,324 | A | | 2/1987 | Palmer |

FOREIGN PATENT DOCUMENTS

| | | | | |
|---|---|---|---|---|
| EP | 0153465 | A2 | | 9/1985 |
| GB | 1407694 | A | | 9/1975 |
| GB | 2160760 | A | | 1/1986 |
| GB | 2402333 | A | | 12/2004 |
| JP | 63-101518 | A | | 5/1988 |
| JP | 63-197201 | U | | 12/1988 |
| JP | 1-174301 | U | | 12/1989 |
| JP | 1-317902 | A | | 12/1989 |
| JP | 2000125839 | A | * | 5/2000 |
| WO | WO 99/43580 | A1 | | 9/1999 |

* cited by examiner

*Primary Examiner* — Anthony Stashick
*Assistant Examiner* — James N Smalley
(74) *Attorney, Agent, or Firm* — Birch, Stewart, Kolasch & Birch, LLP

(57) ABSTRACT

A waste bin and a method for closing a filling hole of a waste bin including a container part, a cover part, and at least one filling hole formed in a side wall of the cover part and/or the container part. A retainer part, which is movable between first and second positions, is arranged between the cover part and the container part of the waste bin. When a temperature of the waste bin is below a predetermined value (T2), the retainer part keeps the cover part in a first position, and a passage via the filling hole to a container space of the container part is kept open. When the temperature has reached the predetermined value (T2), the cover part moves to a second position, and the retainer part moves to the second position, and the passage via the filling hole to the container space is closed.

20 Claims, 12 Drawing Sheets

METHOD FOR CLOSING A WASTE BIN FILLING HOLE AND A WASTE BIN

BACKGROUND OF INVENTION

The invention generally relates to waste bins and particularly to a closing arrangement of a filling hole of waste bins.

The waste bins according to the invention can be utilised as conventional waste bins. Furthermore, the invention can be particularly utilised in connection with vacuum conveying systems, whereby the waste bin is connectable to a piping which is used for collecting and conveying waste, such as conveying household waste.

A problem of waste bins is that materials, which could easily set fire to the litter in the waste bin, can get to them. Such materials are, inter alia, still smouldering cigarette ends, matches etc. In addition, it is also possible that the litter in waste bins in public places are intentionally torched as an act of vandalism.

To get burning litter of waste bins, which operate as the feed points of waste in a vacuum conveying system, into the vacuum conveying system is a great disadvantage and their extinguishing in the piping of the vacuum conveying system can be awkward.

The object of this invention is generally to provide a totally novel arrangement into connection with waste bins, and particularly into connection with waste bins used in connection with vacuum conveying systems which bins are used as the feed point of waste in the vacuum conveying system of waste.

BRIEF DESCRIPTION OF INVENTION

The invention is based on an idea in which the filling hole of a waste bin automatically closes in a fire situation.

Specified in more detail, the method according to the invention is mainly characterised in that between a cover part and a container part of the waste bin is arranged a retainer part which comprises shape memory alloy, which retainer part keeps the cover part in a first position, whereby the filling hole is open and, when the temperature has reached a predetermined value $T_2$, the retainer part moves to a second position in which the cover part is released to move in relation to the container part to a position in which a passage via the filling hole to a container space of the container part is closed.

The waste bin according to the invention is characterised by a retainer part which comprises shape memory alloy, which retainer part keeps a cover part in a first position and, after the temperature of the waste bin has risen, particularly as a result of fire, to a value $T_2$, the retainer part is arranged to set to a second position in which the cover part is movable in relation to a container part to a position in which a passage via the filling hole to a container space of the container part is closed.

The arrangement according to the invention has numerous significant advantages. By utilising the invention, into connection with waste bins is provided an arrangement which prevents the spreading of fire and smothers fire. By preventing the access of air (and oxygen essential to burning) in the container space of the waste bin in a fire situation, a fire already started can be smothered. The arrangement is cost-effective to implement and automatic of its operation. The arrangement is suitable for use in both conventional waste bins and in vacuum conveying systems of waste which comprise the waste bin or equivalent as the feed point. The arrangement according to the invention provides a simple and reliable arrangement for the retainer part of the waste bin and method according to the invention. The shape of the retainer part changes automatically and releases the cover part as long as an adequate thermal effect is applied to the retainer part. The part of the retainer part comprising shape memory alloy can operate as such also as a heating element realising deformation if an electric current is switched through it. Then, it is possible to provide a more extensive system with an automatic control closing the filling holes of the waste bins. The cover part is automatically released when the temperature has risen to a preset temperature characteristic for the deformation of the shape memory alloy. By means of the invention, it is possible to considerably improve the fire-safety of waste bins and the fire-safety of vacuum conveying systems.

BRIEF DESCRIPTION OF FIGURES

Next, the invention will be described in detail by means of an example with reference to the accompanying drawings in which.

DETAILED DESCRIPTION OF INVENTION

Figure 1:
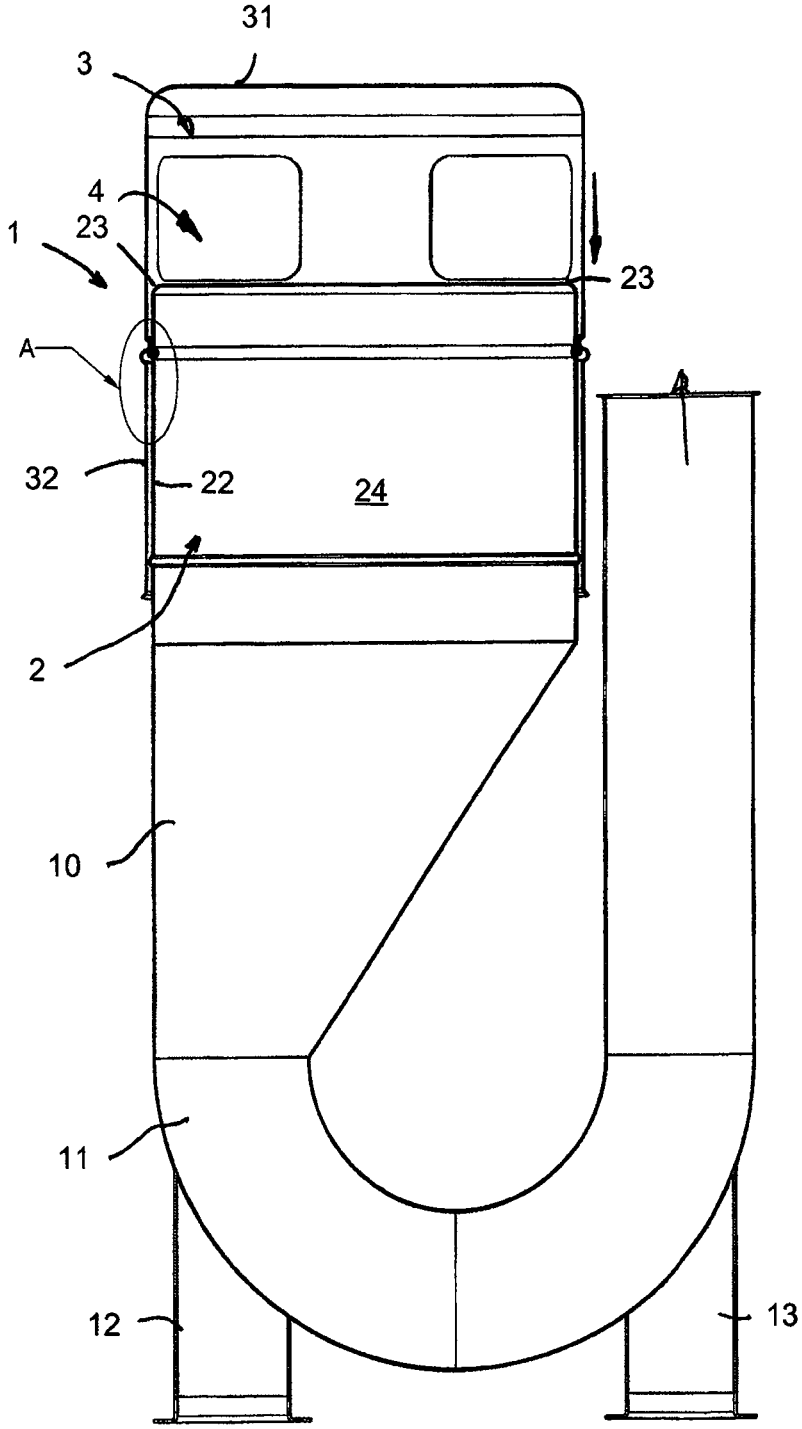
FIG. 1 shows a waste bin in accordance with an embodiment according to the invention in a normal use position.

FIGS. 1-4 show an embodiment of a waste bin 1 according to the invention. The waste bin 1 comprises a container part 2, a cover part 3 in which, in the embodiment of the figure, has been formed at least one filling hole 4. The container part 2 is a vessel open of its upper part. The cover part 3 comprises side walls 32, most suitably a casing-like side wall part, and a cover wall 31. The side walls of the cover part extend downwards from the cover wall. The side walls, advantageously the casing-like side wall part, are arranged outside the side walls 22 of the container part 2. The cover part 3 is arranged to move with respect to the container part 2 between at least two positions, a first position, the normal use position, in which a passage via the filling hole 4 to the container part 2 is open and material can be set via the filling hole 4 to the waste bin, and a second position, the fire position, in which the passage via the filling hole 4 to the container part 2 is closed.

In the embodiment of the figure, at least one filling hole 4 is formed in the side wall 32 of the cover part 3. The filling hole 4 is located in the embodiment of the figures in the use position above an upper edge 23 of the side wall 22 of the container part 2, as shown in FIG. 1. In the second position, the fire position (FIG. 3), the cover part 3 has moved with respect to the container part 2 to the position in which the passage via the filling hole 4 is closed. The filling hole 4 is formed in the side wall 32 of the cover part 3, whereby in the second position the filling hole 4 has moved with respect to the container part 2, along with the cover part 3 to a position in which the filling hole 4, particularly its upper edge 41, is below the upper edge 23 of the side wall 22 of the container part.

Figure 2:
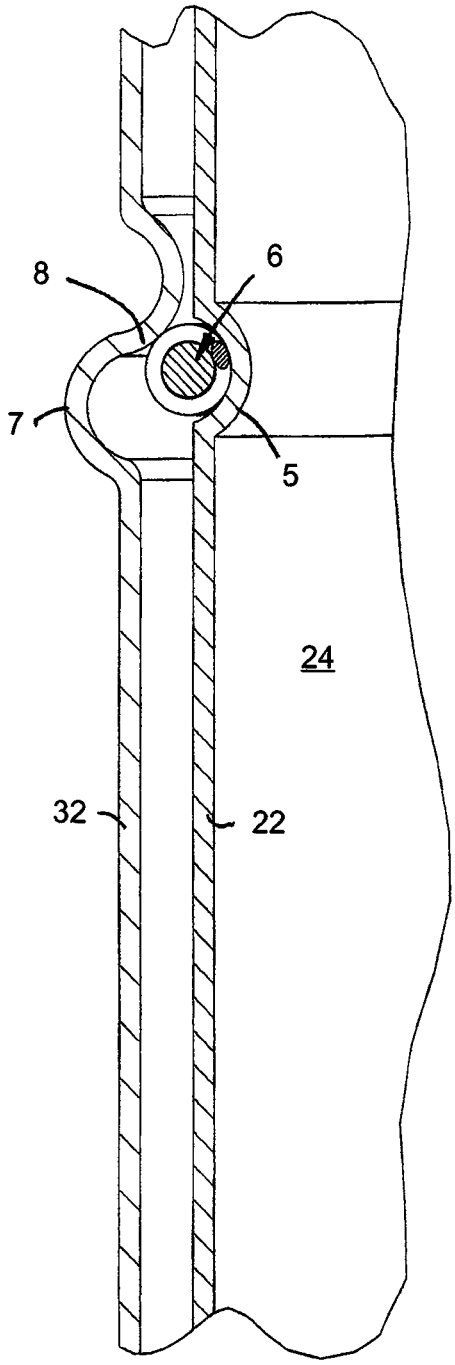
FIG. 2 shows an enlarged view of a detail A of FIG. 1.

The moving of the cover part 3 and/or the container part 2 with respect to each other is enabled with the following arrangement. Between the cover part 3 and the container part 2, particularly between their side walls 22, 32, there is a retainer part 6 which is in the normal position arranged to keep the cover part 3 in the first position. In the normal position, the retainer part 6 has a first length/diameter. In the second position, the retainer part 6 has a second length/diameter. FIG. 2 shows a detail A of FIG. 1. In the wall 23 of the container part 2 has been formed on the side of the cover part 3, on the outer surface in the figure, a recess/groove 5. The dimensions of the retainer part 6 are chosen such that the retainer part 6 extends at a spacing from the outer wall 23 of the container part towards the side wall 32 of the cover part. In the side wall 32 of the cover part is formed a projection 8 which extends towards the side wall 22 of the container part and which projection 8 is in contact with the retainer part 6 in the first position. In the side wall 32 of the cover part 3 is formed a recess 7 which extends at a spacing away from the side wall 32 of the container part.

The retainer part 6 is arranged to deform in a certain temperature. In the embodiment of the figures, the retainer part 6 is an annular part, whereby in the first position the circle of the retainer part has a first length and it has a first diameter d when it is annular. Then, the retainer part is in the recess 5. The projection 8 of the cover part is in contact with the retainer part and the cover part 3 is in the first position supported by the retainer part 6. In the second position, the retainer part 6 has a second length which is in the embodiment of the figures larger than the first length. In the embodiment of the figures, the retainer part 6 has in the second position a second diameter d when its shape is annular, whereby the retainer part 6 when deforming extends towards the groove 7 of the wall 32 of the cover part. When the diameter d of the circle of the retainer part has increased enough, the retainer part will no longer be in contact with the wall 22 of the container part, whereby the cover part 3 is released from a locking formed by the retainer part and is able to move to the second position, FIGS. 3 and 4. In FIG. 4, the annular retainer part 6 has increased to the second length and the second diameter and is set in the recess 7 of the side wall 32 of the cover part 3.

The upper edge of the filling hole 4 has moved along with the cover part with respect to the container part 2 below the upper edge 23 of the side wall of the container part, whereby the connection from outside via the filling hole 4 to a container space 24 of the container part is closed.

The retainer part 6 advantageously comprises shape memory alloy (SMA). The shape memory alloy can have a predetermined temperature in which the deformation occurs. It can be considered that in the container space 24 of the waste bin 1 the temperature rises as a result of a fire started from a value $T_1$ to a value $T_2$. Then, the retainer part 6 deforms and the cover part 3 is able to move to the second position, whereby the passage via the filling hole 4 to the container is closed and also the access of oxygen required for burning in the waste bin is substantially prevented. This considerably improves the fire-safety for the part of waste bins and makes it more difficult for the fire to spread outside the waste bins.

Figure 3:
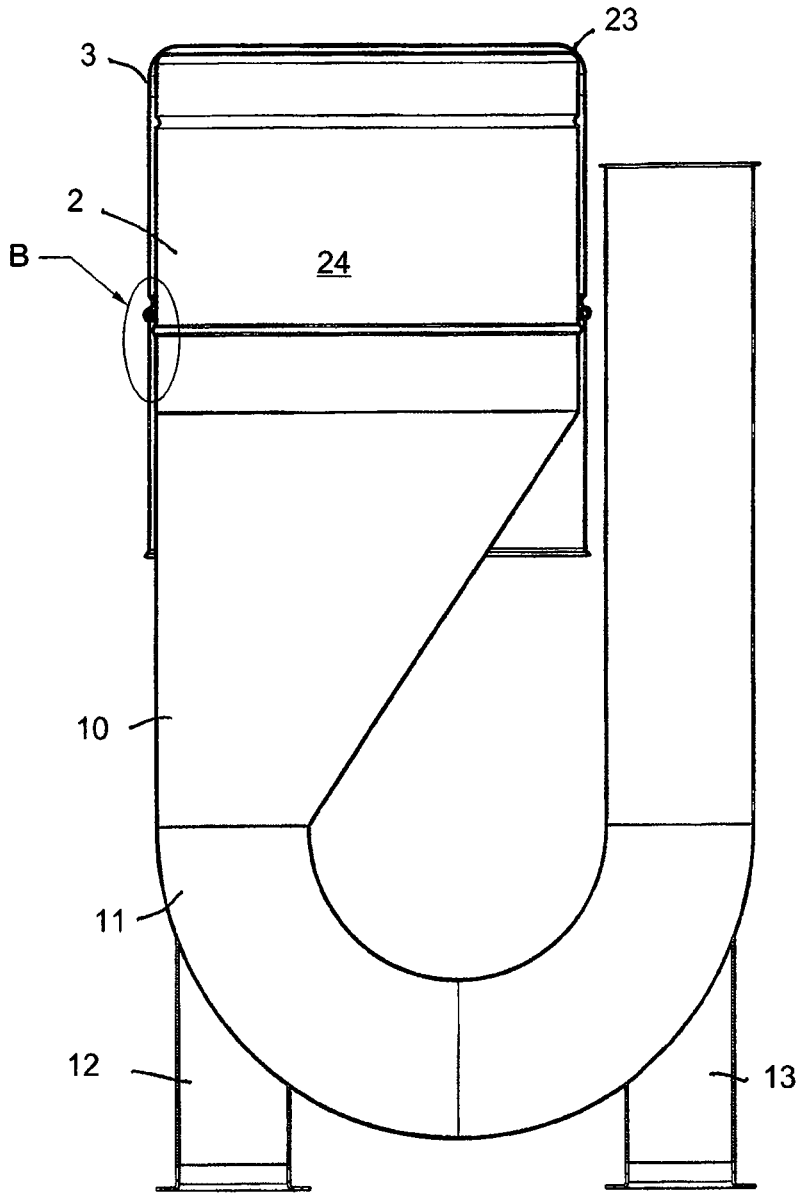
FIG. 3 shows a waste bin in accordance with an embodiment according to the invention in a second position in which filling holes are in a closed position.
Figure 4:
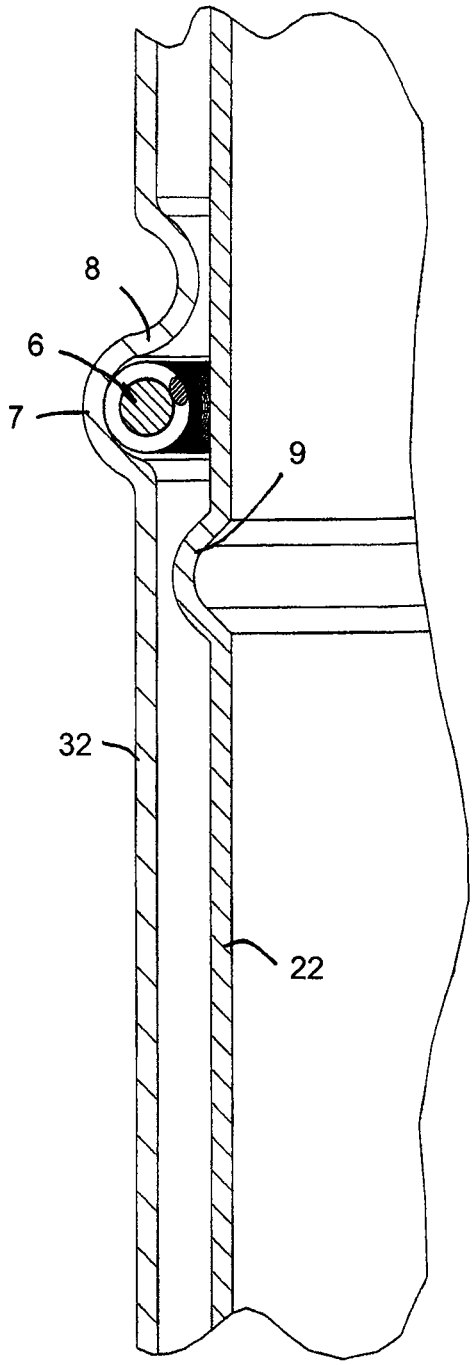
FIG. 4 shows an enlarged view of a detail B of FIG. 3.
Figure 5:
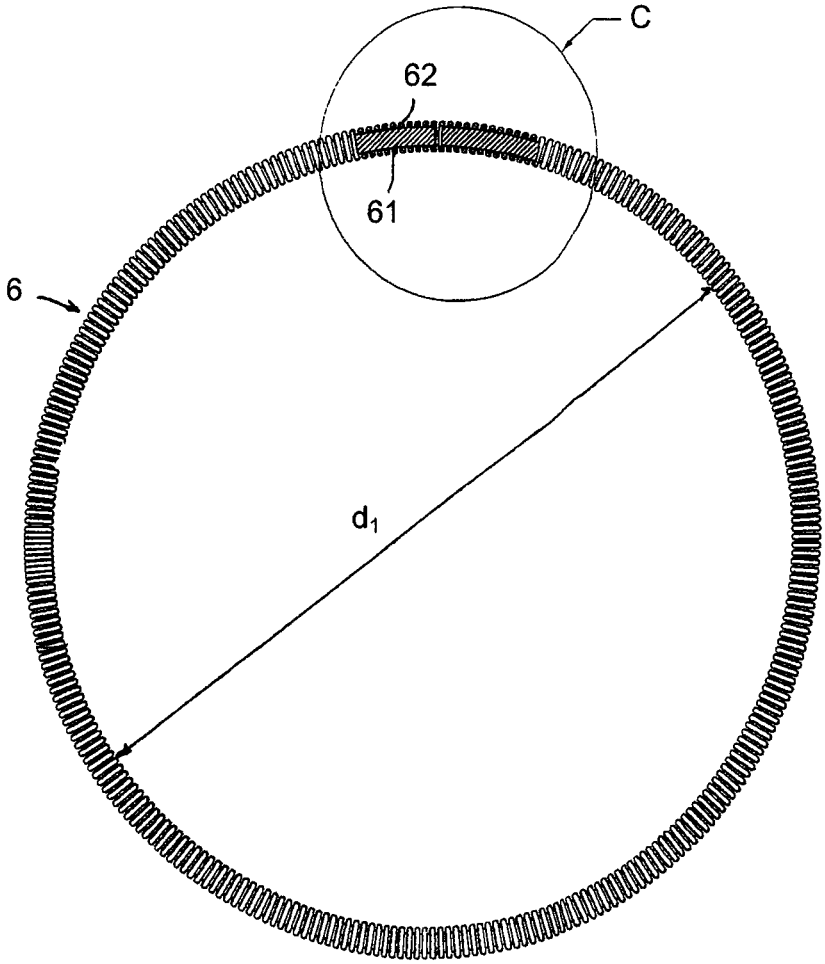
FIG. 5 shows a part of an arrangement according to the invention in a first position.
Figure 6:
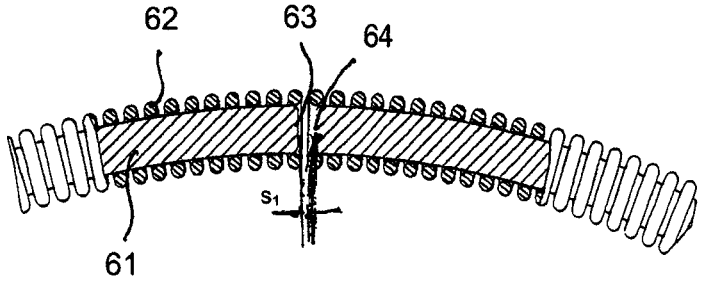
FIG. 6 shows an enlarged view of a detail C of FIG. 5.
Figure 7:
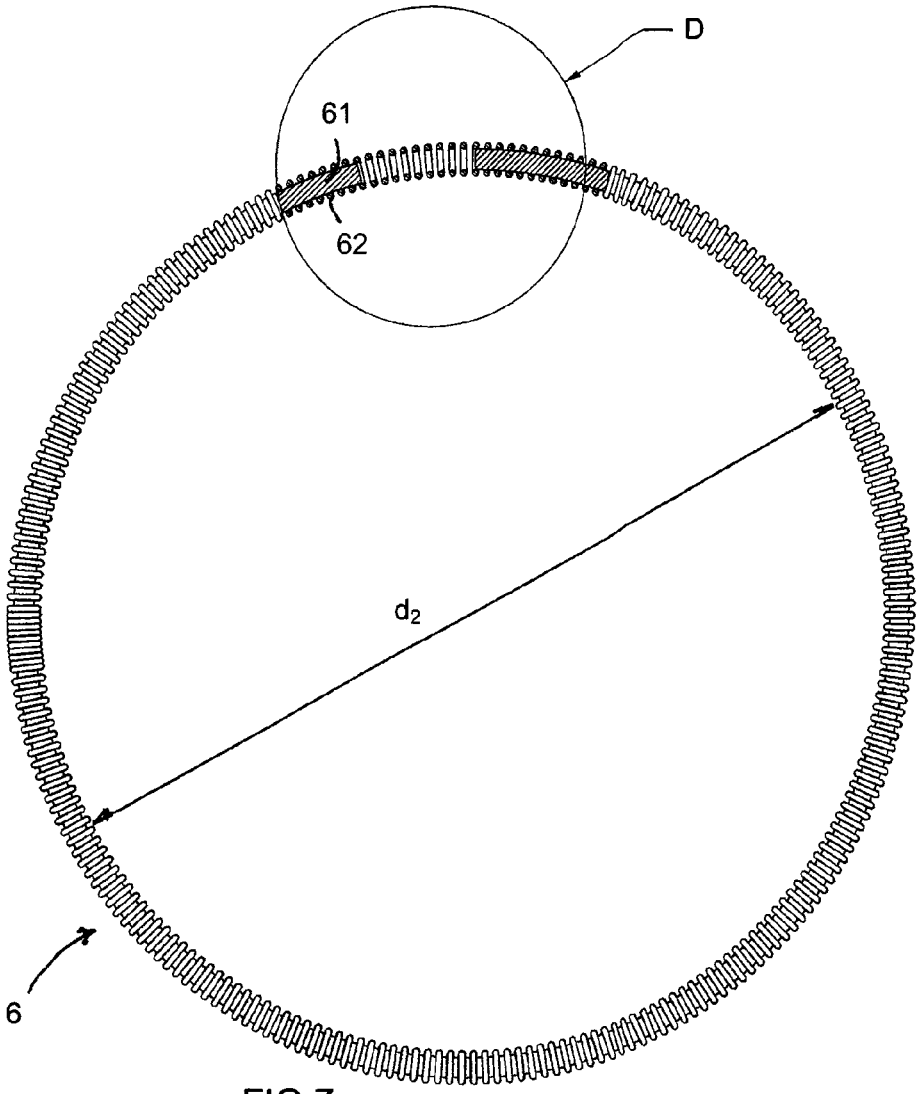
FIG. 7 shows a part of an arrangement according to the invention in a second position.
Figure 8:
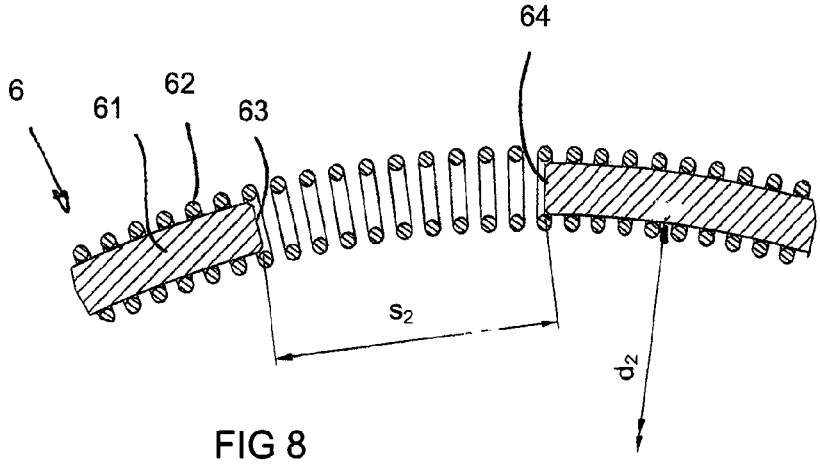
FIG. 8 shows an enlarged view of a detail D of FIG. 7.

In the embodiments of FIGS. 1-4, in which the waste bin 1 is a feed point in the vacuum conveying system of waste, the arrangement according to the invention impedes the fire from spreading to the conveying piping. Suction provided in the vacuum conveying piping furthers the moving of the cover part 3 to the second position. Additionally, the suction/vacuum affects by diminishing the fire, inter alia, by removing oxygen required in burning from the waste bin. FIGS. 1 and 3 show a part of conveying piping connected to the container part 1, which is used in the vacuum conveying system of waste. Then, the lower part of the container part 2 is connected with a reducer part 10 to a pipe part 11. The pipe part 11 is further connected to the actual conveying piping (not shown in the figures). In the embodiment are also arranged support parts 12, 13 supported by which the waste bin is sustained on an installation surface, such as a floor.

The retainer part 6 can be totally of shape memory alloy or part of the retainer part is of shape memory alloy. In the embodiment of FIGS. 5-8, the retainer part 6 comprises a core part 61 and a twisted wire part 62 around it. According to the first embodiment, the core part 61 is formed of shape memory alloy. Then, at the temperature $T_1$ i.e. the normal temperature, the shape memory alloy wire forming the core part is ductile and the outer twisted wire part 62 pulls a first end 63 and a second end 64 of the core part 61 together.

When the temperature reaches the second temperature $T_2$, i.e. the training temperature of shape memory alloy, the core part 61 deforms in a trained way. In the embodiment according to the invention, the core part functions like spring steel after the temperature has risen to the training temperature $T_2$ or above it. The diameter d of the retainer part 6 increases from a first diameter $d_1$ to a second diameter $d_2$ and the length of its circle increases. The ends 63, 64 of the core part thus move from a first spacing $s_1$ to a second spacing $s_2$ away from each other.

According to the second embodiment, the twisted wire part 62 is of shape memory alloy, whereby its length changes after the temperature has reached a predetermined value.

Figure 9:
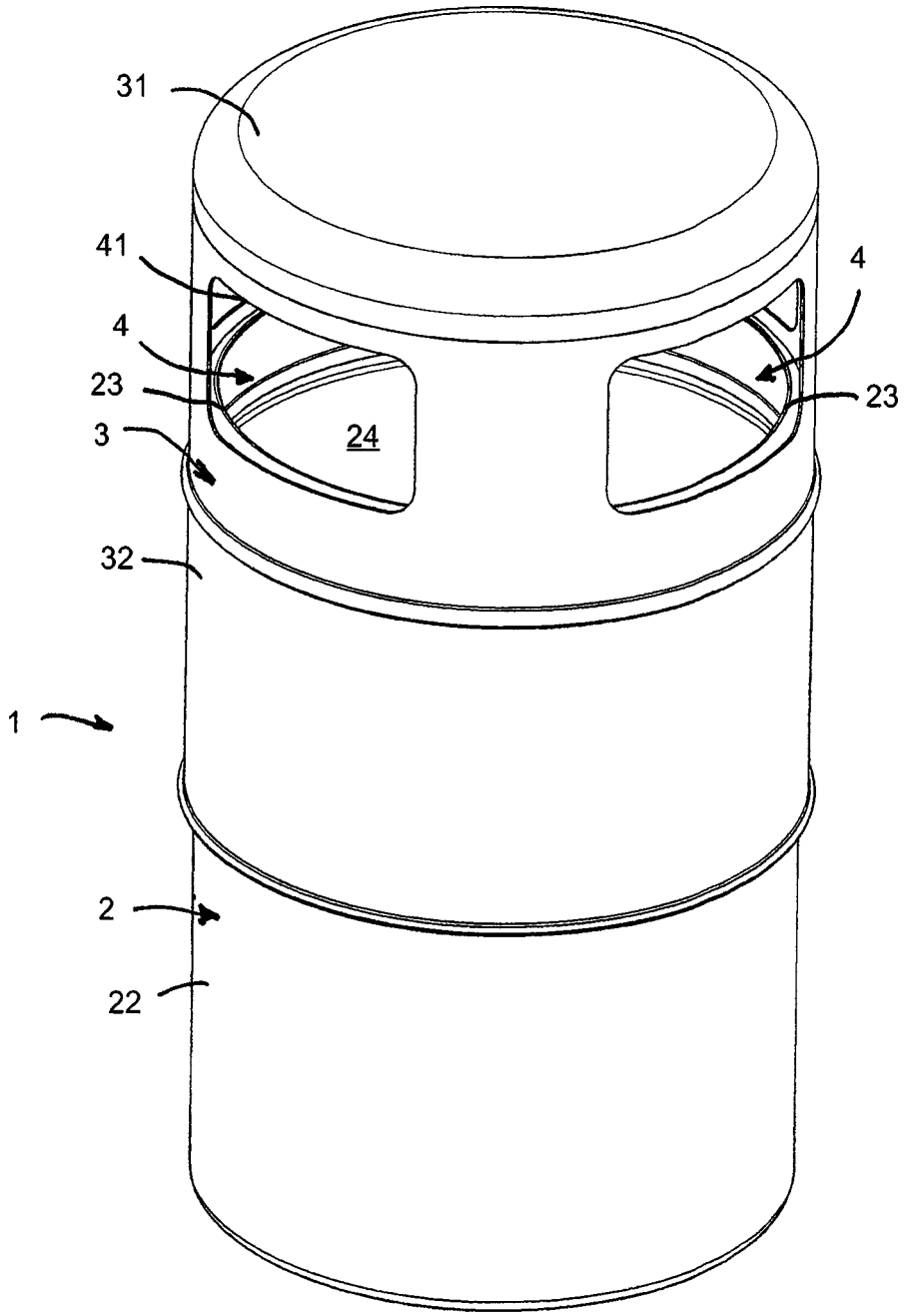
FIG. 9 shows another embodiment of an arrangement according to the invention in connection with a waste bin in a normal use position.
Figure 10:
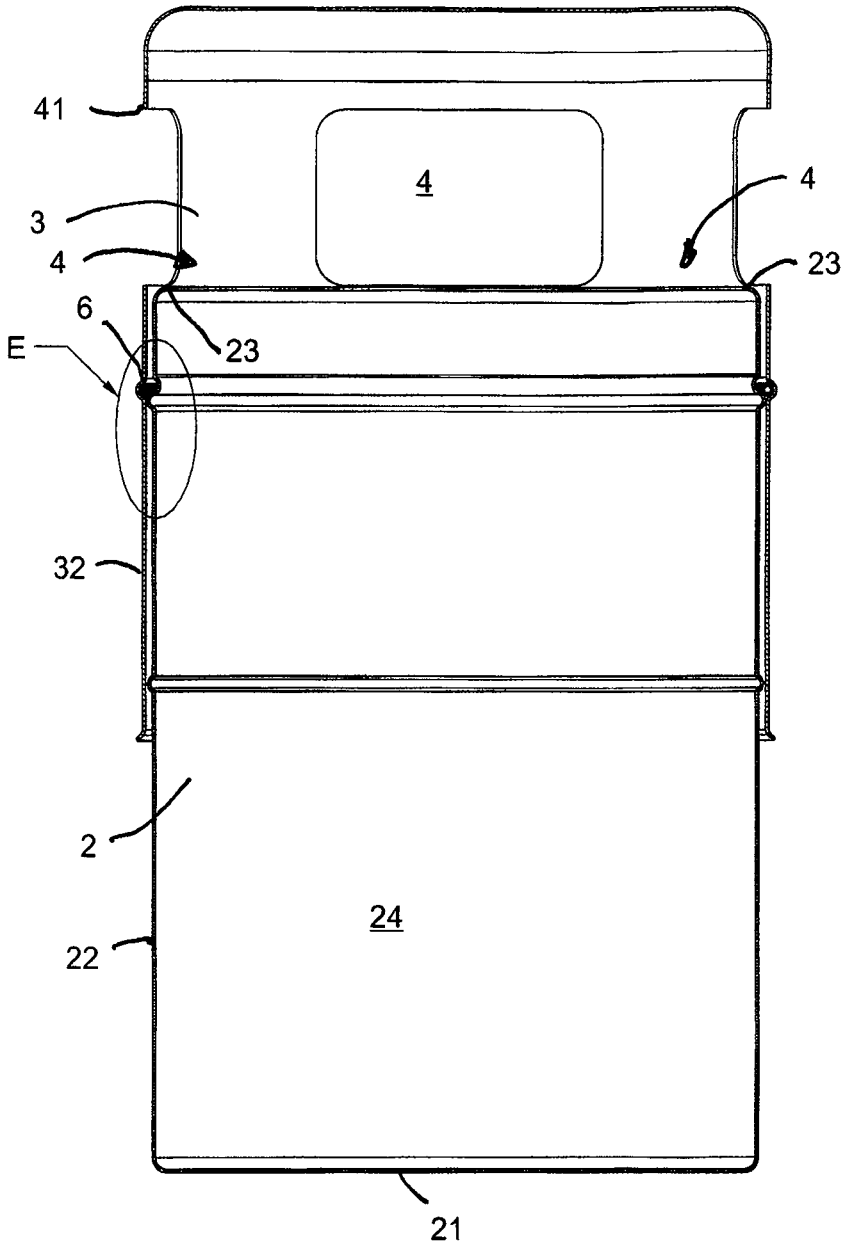
FIG. 10 shows a vertical cross-section of the waste bin according to FIG. 9.
Figure 11:
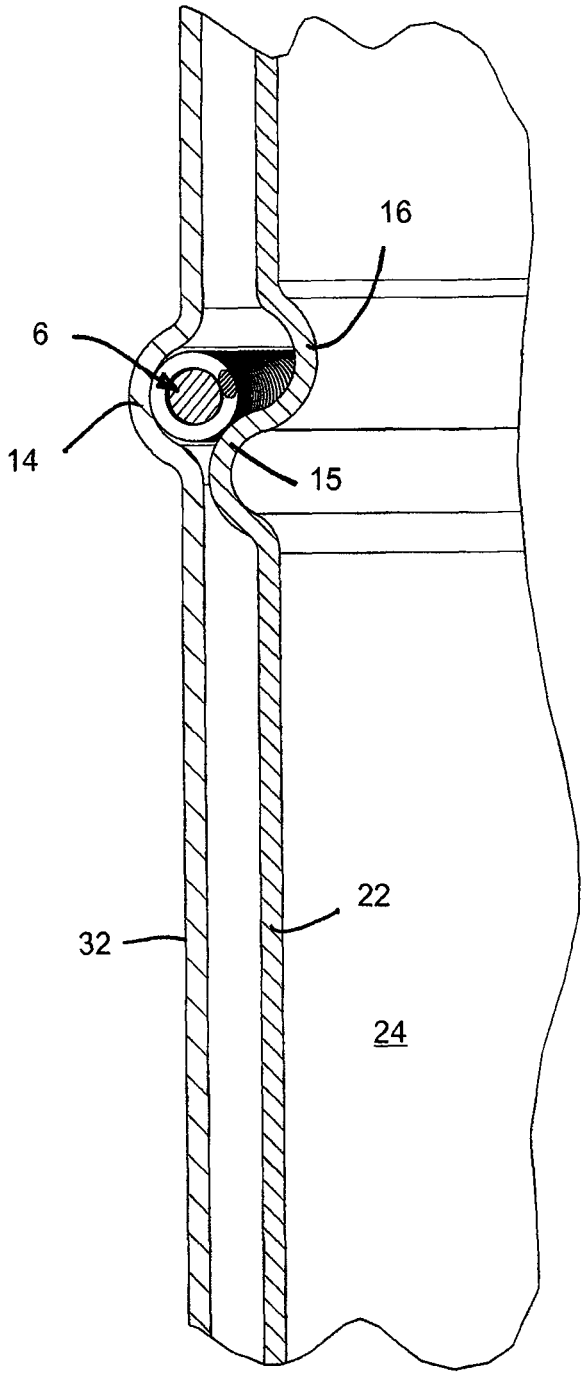
FIG. 11 shows an enlarged view of a detail E of FIG. 10.

FIGS. 9-14 show another embodiment of the arrangement according to the invention. In them, the invention has been applied in connection with a conventional waste bin which is not connected, like the first embodiment, to the vacuum conveying system of waste. Furthermore, an embodiment has been illustrated in which the length of the circle of the retainer part 6 shortens (and the diameter d decreases) from the first position to the second position as the temperature rises. FIGS. 9 and 10 show the waste bin 1 in the first position in which the filling holes 4 are open and waste can be set via them to the container part 2. In the embodiment, the container part 2 is a vessel which comprises a bottom 21 and side walls 22 extending upwards from it. The cross-section of the side wall part is mainly peripherical, e.g. circular or elliptical. The container part 2 is a vessel open of its upper part. On the side of the open upper end of the container part 2 is arranged the cover part 3. The cover part 3 comprises the cover wall 31 and the side wall 32 extending crosswise from it, downwards in the figure. The side wall 32 is cylindrical and at least one opening has been formed in it, the filling hole 4. The cover part 3 is arranged on top of the container part so that the wall 22 of the container part remains inside a circle formed by the wall 32 of the cover part. The cover wall of the cover part forms an upper wall i.e. roof of the waste bin. The upper edge of the filling hole 4 is in the first position above the upper edge 23 of the side wall of the container part 2, whereby material can be set in the container of the waste bin via the filling hole 4.

According to the embodiment of FIGS. 9-14, the length of the retainer part 6 shortens and the diameter d decreases after the temperature has reached the predetermined value $T_2$. Then, a retainer ring is in the first position located in a recess 14 formed in the cover part and a projection 15 is formed in the wall 22 of the container part which supports the retainer part 6. Then, the cover part stays in the first position supported by the retainer part sustained on the container part. In the second position, when the temperature reaches the predetermined value, e.g. heated by the contents of the waste bin having started to burn, the retainer part 6 deforms, whereby the length of the circle of the annular retainer part shortens i.e. its diameter d decreases. Then, the retainer part 6 moves to a recess 16 formed above the projection 15 of the wall 22 of the container part, whereby the cover part 3 is released and, e.g. from the effect of gravity, moves to the second position (FIGS. 12-14) by moving downwards in the case of the figures.

Figure 12:
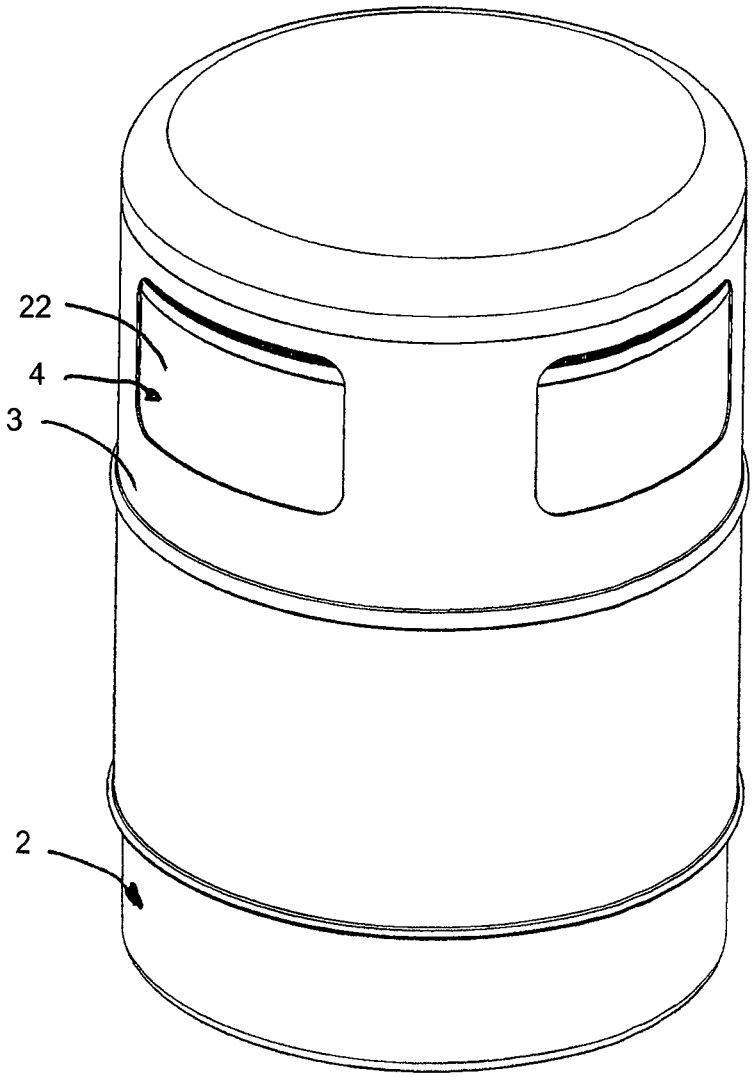
FIG. 12 shows another waste bin in accordance with an embodiment according to the invention in a second position in which filling holes are in a closed position.
Figure 13:
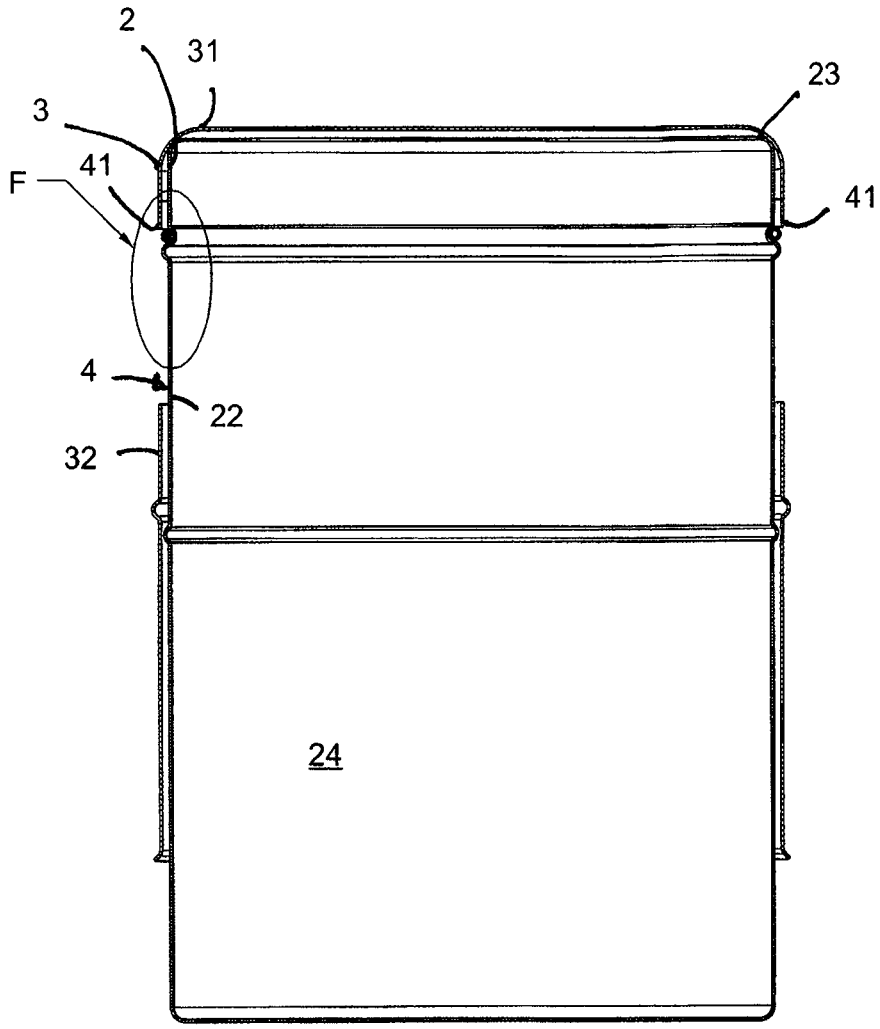
FIG. 13 shows a vertical cross-section of the waste bin according to FIG. 12.
Figure 14:
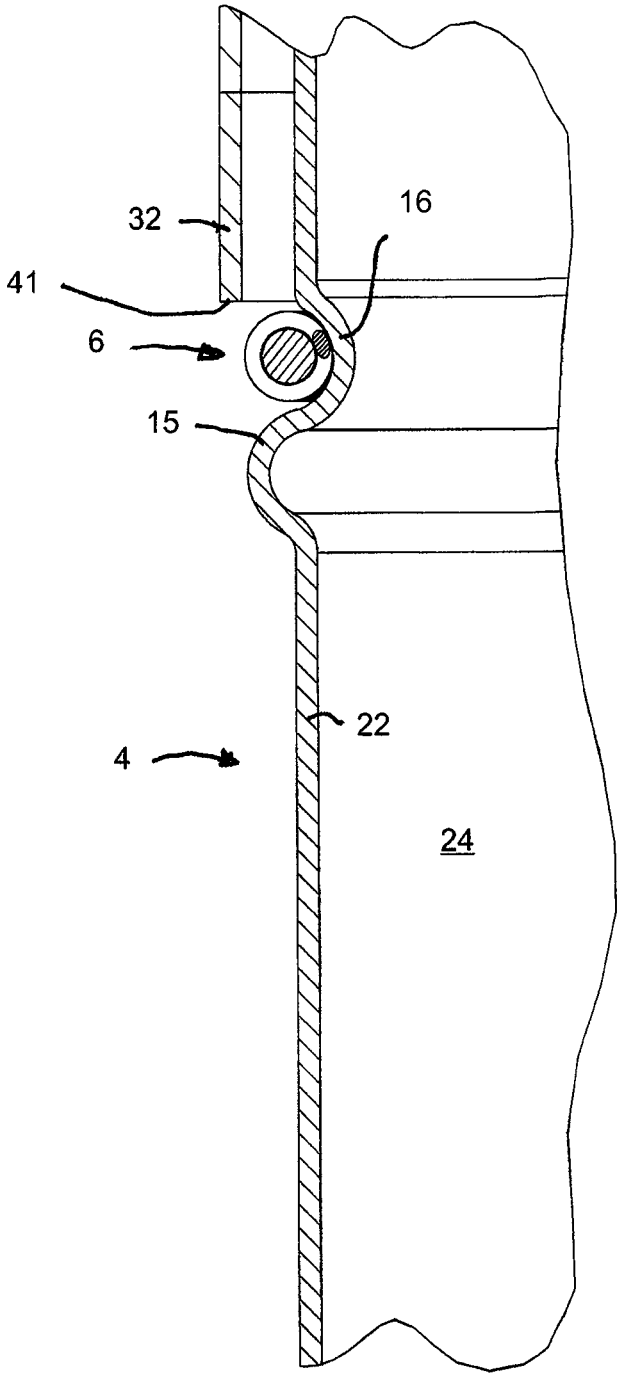
FIG. 14 shows an enlarged view of a detail F of FIG. 13.

Because of the mutual motion of the cover part and the container part, the passage via the filling hole 4 to the container space 24 of the container part 2 closes. In the embodiment of the figures, the upper edge 41 of the filling hole moves along with the cover part below the upper edge of the side wall of the container part. In FIG. 12, it can be observed that the upper edge of the wall 22 of the container part is almost in contact with the cover wall 31 of the cover part in the second position.

According to an advantageous embodiment, the retainer part is a lock ring which prevents the container part 2 and the cover part 3 from moving with respect to each other in the locking position.

The invention thus relates to a method for closing a filling hole of a waste bin 1, which waste bin comprises a container part 2 and a cover part 3 and at least one filling hole 4 which is formed in a side wall of the cover part 3 and/or the container part 2. Between the cover part 3 and the container part 2 of the waste bin is arranged a retainer part 6, which retainer part keeps the cover part in a first position, whereby the filling hole 4 is open and, when the temperature has reached a predetermined value $T_2$, the retainer part 6 moves to a second position in which the cover part 3 is released to move with respect to the container part 2 to a position in which a passage via the filling hole 4 to a container space 24 of the container part 2 is closed.

According to an embodiment of the invention, the retainer part 6 is an annular part the diameter d of which increases when the temperature reaches the predetermined value $T_2$.

According to another embodiment of the invention, the retainer part 6 is an annular part the diameter d of which decreases when the temperature has reached the predetermined value $T_2$.

Typically, the temperature reaches the predetermined value $T_2$ in a fire situation. The predetermined value $T_2$ can be e.g. 70-100 degrees C.

According to an advantageous embodiment, the retainer part comprises shape memory alloy.

According to an embodiment, the retainer part 6 is used as a lock ring.

Typically, when the retainer part has moved to the second position, the cover part is able to move to the second position from the effect of gravity.

The moving of the cover part 3 is assisted by means of underpressure prevailing in the waste bin when the waste bin is a part of the vacuum conveying system of waste.

The invention also relates to a waste bin which comprises a container part 2 and a cover part 3, in which cover part and/or container part there is a filling hole 4 and which cover part is movable with respect to the container part from a first position, in which a passage via the filling hole to the container part is open, to a second position, in which the passage via the filling hole to the container part is closed. The invention is characterised by a retainer part 6 which retainer part keeps the cover part 3 in the first position and, after the temperature of the waste bin has risen, particularly as a result of fire, to a value $T_2$, the retainer part 6 is arranged to set to the second position in which the cover part 3 is movable in relation to the container part 2 to the position in which the passage via the filling hole 4 to the container part 2 is closed.

According to a typical embodiment, the retainer part 6 is an annular part.

According to an advantageous embodiment, the retainer part comprises shape memory alloy.

According to an advantageous embodiment, in the wall of the container part 2 is formed a groove 5 for the retainer part 6 and in the wall of the cover part 3 a projection part 8 which supports itself on the retainer part 6 in the first position.

In the wall of the cover part 3 is formed a recess 7 in which the retainer part 6 is arranged to move to the second position, whereby the cover part has been released to move with respect to the container part.

According to an advantageous embodiment, the retainer part 6 comprises a core part 61 and a twisted wire part 62. Then, at least one of the parts of the retainer part can comprise shape memory alloy. Then, it is also possible to spare shape memory alloy by producing the other part of some other material without the functionality suffering.

According to an embodiment, the core part 61 of the retainer part 6 is of shape memory alloy.

According to another embodiment, the twisted wire part 62 of the retainer part 6 is of shape memory alloy.

According to a typical embodiment, the waste bin 1 is a separate unit. The invention can be utilised in quite ordinary waste bins.

According to another embodiment, the waste bin is a part of a vacuum conveying system of waste, particularly a feed point of the system.

The retainer part comprising shape memory alloy can also be remote controlled by connecting electric wires to it, whereby the shape memory alloy element functions as a thermal element. The risen heat of the element makes the retainer part to move from the first position to the second position, whereby the cover is released to move from the first position to the second position. The part of the retainer part comprising shape memory alloy can be connected as a part of an electric circuit in which electric current can be switched on. By switching the electric wires controllably on, the filling holes of the waste bins can be closed either one by one or as groups of several waste bins.

This specification does not describe how to 'train' the retainer part comprising shape memory alloy, but it is assumed known as such from the other applications of shape memory alloys. The used shape memory alloy can be any suitable shape memory alloy. An alloy extensively used as shape memory alloy is e.g. Nitinol i.e. NiTi alloy.

The retainer part can be partly or totally formed of some other material acting correspondingly. An alternative arrangement is e.g. bimetal. Equivalently, e.g. the core part of the retainer part can be formed of bimetal. The bimetal is a strip made of two metals expanding in different ways. The strips are connected fast to each other such that they are able to expand freely. This provides the fact that a change in temperature changes the form of the strip. The bimetal deflects in a different direction when heating up compared to the one when cooling down.

It is obvious to those skilled in the art that the invention is not limited to the embodiments described above, but it may be varied within the scope of the enclosed claims. When necessary, the features possibly described in this specification together with other features may also be used separately from each other.

The invention claimed is:

1. A method for closing a filling hole of a waste bin comprising:

a container part, a cover part, at least one filling hole which is formed in a side wall of the cover part and/or the container part, and a retainer part, which is movable between first and second positions, is arranged between the cover part and the container part of the waste bin, wherein when a temperature of the waste bin is less than a predetermined value (T2), the method comprising:

keeping the retaining part in a first position of the retaining part and keeping the cover part in a first position of the cover part, whereby a passage via the filling hole to a container space of the container part is open, and wherein when the temperature of the waste bin rises to the predetermined value (T2), the method comprising:

moving the retainer part to a second position of the retainer and moving the cover part with respect to the container part to a second position of the cover part in which the passage via the filling hole to container space of the container part is closed, wherein the retainer part is an annular part, and a diameter (d) of the annular part increases when the temperature of the waste bin rises to the predetermined value (T2).

2. The method according to claim 1, wherein a wall of the container part includes a groove for the retainer part, and a wall of the cover part includes a projection part which supports itself on the retainer part when the retainer part is in the first position.

3. A waste bin, comprising:

a container part, a cover part, and a filling hole in the cover part and/or the container part, wherein the cover part is movable with respect to the container part from a first position, in which a passage via the filling hole to the container part is open, to a second position, in which the passage via the filling hole to the container part is closed, and further comprising:

a retainer part which keeps the cover part in the first position when a temperature of the waste bin is below a predetermined value (T2) and, after the temperature of the waste bin has risen to the predetermined value (T2), the retainer part is arranged in a manner to enable the cover art to move with respect to the container part from the first position to the second position, in which the passage via the filling hole to a container space of the container part is closed, wherein a wall of the container part includes a groove for accommodating the retainer part, and a wall of the cover part includes a projection part which supports itself on the retainer part when the retainer part is accommodated in the groove.

4. The method according to claim 1 wherein the retainer part comprises shape memory alloy.

5. The method according to claim wherein the temperature rises to the predetermined value (T2) in a fire situation.

6. The method according to claim 1, wherein the retainer part is a lock ring.

7. The method according to claim 1, further comprising:

moving the cover part to the second position from an effect of gravity.

8. The method according to claim 1, wherein the moving of the cover part to the second position is assisted by means of an underpressure prevailing in the waste bin, when the waste bin is a part of a vacuum conveying system of waste.

9. The waste bin according to claim 3, wherein the retainer part is an annular part, and the diameter (d) of the annular part decreases after the temperature of the waste bin has reached the predetermined value (T2).

10. The waste bin according to claim 3, wherein the retainer part comprises shape memory alloy.

11. The waste bin according to claim 3, wherein the retainer part is an annular part.

12. The waste bin according to claim 3, wherein the wall of the container part is a side wall of the container part, and the wall of the cover part is a side wall of the cover part, wherein the groove on the container part and the projection part on the cover part each extend inwardly toward an interior of the waste bin.

13. A waste bin comprising:

a container part, a cover part which is movable between first and second positions thereof, and a filling hole in the cover part and/or the container part, wherein the cover part is movable with respect to the container part from the first position thereof, in which a passage via the filling hole to the container part is open, and to the second position thereof, in which the passage via the filling hole to the container part is closed, and further comprising:

a retainer part which is movable between first and second positions thereof, wherein when temperature of the waste bin is below a predetermined value (T2), the retainer part is in the first position, the cover part is in the first position, and a passage via the filling hole to a container space of the container part is open, and wherein when temperature of the waste bin has reaches the predetermined value (T2), the retainer part in the second position, the cover part is in the second position, and the passage via the filling hole to the container space of the container part is closed, wherein a wall of the cover part is formed with a recess in which the retainer part is in the second position to enable the cover part to move to the second position, whereby the cover part is released to move with respect to the container part.

14. The waste bin according to claim 3, wherein the retainer part comprises a core part and a twisted wire part.

15. The waste bin according to claim 10, wherein the core part of the retainer part comprises shape memory alloy.

16. The waste bin according to claim 3, wherein a twisted wire part of the retainer part comprises shape memory alloy.

17. The waste bin according to claim 3, wherein the waste bin is a separate unit.

18. An apparatus according to claim 3, wherein the waste bin is a feed point of a vacuum conveying system of waste.

19. The apparatus according to claim 13, wherein the retainer part comprises shape memory alloy.

20. The method according to claim 9, wherein the retainer part comprises shape memory alloy.

* * * * *